US005303909A

United States Patent [19]

Maylaender

[11] Patent Number: 5,303,909

[45] Date of Patent: Apr. 19, 1994

[54] PAPER WEB GUIDE ASSEMBLY WITH THREE FORMING LEVELS

[75] Inventor: Edgar Maylaender, Estenfeld, Fed. Rep. of Germany

[73] Assignee: Koenig & Bauer Aktiengesellschaft, Wurzburg, Fed. Rep. of Germany

[21] Appl. No.: 934,267

[22] Filed: Aug. 25, 1992

[30] Foreign Application Priority Data

Aug. 30, 1991 [DE] Fed. Rep. of Germany ..... 4128797

[51] Int. Cl.[5] ..... B41F 13/58; B41F 11/00

[52] U.S. Cl. ..... 270/5; 270/10; 270/41

[58] Field of Search ..... 270/1.1, 5, 6, 10, 19, 270/20.1, 21.1, 32, 41, 43, 47

[56] References Cited

U.S. PATENT DOCUMENTS 660,726 10/1900 Hartt ..... 270/41
752,807 2/1904 Spalckhaver ..... 270/6
868,918 10/1907 Firm ..... 270/41
1,312,458 8/1919 Seymour ..... 270/32
3,942,782 3/1974 Hermach ..... 270/5
4,671,501 6/1987 Fujishiro ..... 270/21.1
4,725,050 7/1986 Fugishiro ..... 270/6

FOREIGN PATENT DOCUMENTS 2510057 3/1975 Fed. Rep. of Germany .

*Primary Examiner*—Edward K. Look
*Assistant Examiner*—John Ryznic
*Attorney, Agent, or Firm*—Jones, Tullar & Cooper

[57] ABSTRACT

A paper web guide assembly utilizes a plurality of longitudinal formers that are arranged in three levels. The formers in the upper level receive a web from a first six plate width press while the formers in the intermediate and lower levels receive web segments from a second six plate width press. The formed ribbons can be directed over a plurality of paths of travel.

3 Claims, 3 Drawing Sheets

PAPER WEB GUIDE ASSEMBLY WITH THREE FORMING LEVELS

FIELD OF THE INVENTION

The present invention is directed generally to a paper web guide assembly. More particularly, the present invention is directed to a paper web-guide assembly for a web-fed rotary printing press. Most specifically, the present invention is directed to a paper web guide assembly having six longitudinal formers arranged in three levels. Each of the six longitudinal formers receives a paper web that it forms into a paper ribbon. Three longitudinal formers are situated in an upper level and the remaining three longitudinal formers are divided between an intermediate level and a lower level. Two web-fed rotary printing presses, each with a six plate width are used to print the webs. The web from a first press goes to the three formers on the upper level while the web from a second press is divided into web segments which go to the formers on the intermediate and lower levels.

DESCRIPTION OF THE PRIOR ART

Paper web guide assemblies, which are utilized with web-fed rotary printing presses are generally known in the art. A web is printed by a rotary press, it then slit into a plurality of webs and each web is then longitudinally formed into a ribbon. The formed ribbons may then be placed atop one another in a folder and are then cut and folded to form a printed product. A significant limitation of the various prior art paper web guide assemblies is the limit on the various arrangements in which the formed ribbons can be layered on each other prior to being cross cut and folded. Since each former accomplishes only one longitudinal fold, there must be at least half as many formers as there are printing plate widths of printing cylinders in the web-fed press. The prior arrangement of these formers has not provided as large a degree of flexibility as is desired.

In one prior art device, as shown in U.S. Pat. No. 3,942,782 there is shown an arrangement of longitudinal formers as depicted in FIG. 4 of the accompanying drawings. In this prior art device three longitudinal formers are arranged adjacent each other to form the paper ribbons A, B, and C. Three additional longitudinal formers are arranged adjacent each other to form ribbons D, E, and F. The formers in the upper level are arranged generally directly above the formers in the lower level. This is the typical arrangement when the printed web supplied to the formers A, B, and C and the printed web supplied to the formers D, E, and F are produced by web-fed rotary printing presses that have six plate width configurations.

Because of the inherent lack of flexibility afforded by such a prior art paper web guide arrangement, as depicted in FIG. 4, it is not possible to produce a product in which, for example, the ribbons from formers A and F can be adjacent each other. Such a desired arrangement might well be necessary for different reasons, such as a different number of pages, differently colored papers, or a different number of inks. In this depicted prior art arrangement, if, for example, it is desired to bring the ribbon E between the ribbons A and B, a significant amount of turning of the ribbon E must be accomplished. Each time the ribbon is turned, it is apt to be disturbed or displaced with respect to the ribbons that it is to be placed between. Such displacements cause errors in the assembled product. In this prior art device depicted in FIG. 4, the ribbons A, B, and C are not capable of being varied in their direction of movement.

Various commercially available web-fed rotary presses, such as those designed by the United States company Goss and the Japanese company Toshiba utilize impression cylinders that have a four plate width configuration. In these prior art devices, which are depicted generally in FIG. 5 of the accompanying drawings, the longitudinal formers are arranged in a three level configuration. This three level configuration provides a greater flexibility in the various arrangements in which ribbons A–F can be positioned. However in devices of this type since the impression cylinders have only a four plate wide configuration, there are required a greater number of printing units and associated devices to print a product as compared to the numbers of printing units and associated devices which are required of a six plate width assembly.

It will thus be seen that a need exists to improve the flexibility of these paper web guide assemblies. The paper web guide assembly of the present invention provides such a device and is an improvement over the prior art devices.

SUMMARY OF THE INVENTION

It is an object of the present invention to provide a paper web guide assembly.

Another object of the present invention is to provide a paper web guide assembly for a web-fed rotary printing press.

A further object of the present invention is to provide a paper web guide assembly having six longitudinal formers.

Yet another object of the present invention is to provide a paper web guide assembly having six longitudinal formers arranged in three levels.

Still a further object of the present invention is to provide a paper web guide assembly having a plurality of six plate width presses.

Even yet another object of the present invention is to provide a paper web guide assembly in which the longitudinal formers in the intermediate and lower levels receive the printed webs from a six plate width press.

As will be discussed in greater detail in the description of the preferred embodiment which is presented subsequently, the paper web guide assembly in accordance with the present invention utilizes six longitudinal formers arranged in three levels. Three of the formers are situated in an upper level while the other three formers are divided between intermediate and lower levels. The three longitudinal formers in the upper level receive printed webs from a first six plate wide press. The web from a second six plate wide press are divided into web segments which are directed to the intermediate and lower level formers.

The primary advantage of the paper web guide assembly of the present invention is its increased flexibility in arranging formed ribbons from the three levels of the formers prior to their being cross folded and cut into printed products. Since the two rotary presses are each six plate width devices there are fewer printing units and their associated devices. The use of fewer printing units reduces the expenditures required to operate the printing press. At the same time, the use of the three level longitudinal former configuration of the present invention affords a greater degree of flexibility than was possible with the prior art devices.

Further, since the presses are six plate width units, there is a reduction in the overall length of the rotary press since the number f devices, such as reel changes, guide rollers and the like, is reduced.

The paper web guide assembly of the present device increases the flexibility of paper ribbon arranging. It is a substantial advance in the art.

BRIEF DESCRIPTION OF THE DRAWINGS

While the novel features of the paper web guide assembly in accordance with the present invention are set forth with particularity in the appended claims, a full and complete understanding of the invention may be had by referring to the detailed description of the preferred embodiment, which is presented subsequently, and as illustrated in the accompanying drawings, in which:

DESCRIPTION OF THE PREFERRED EMBODIMENT

Figure 1:
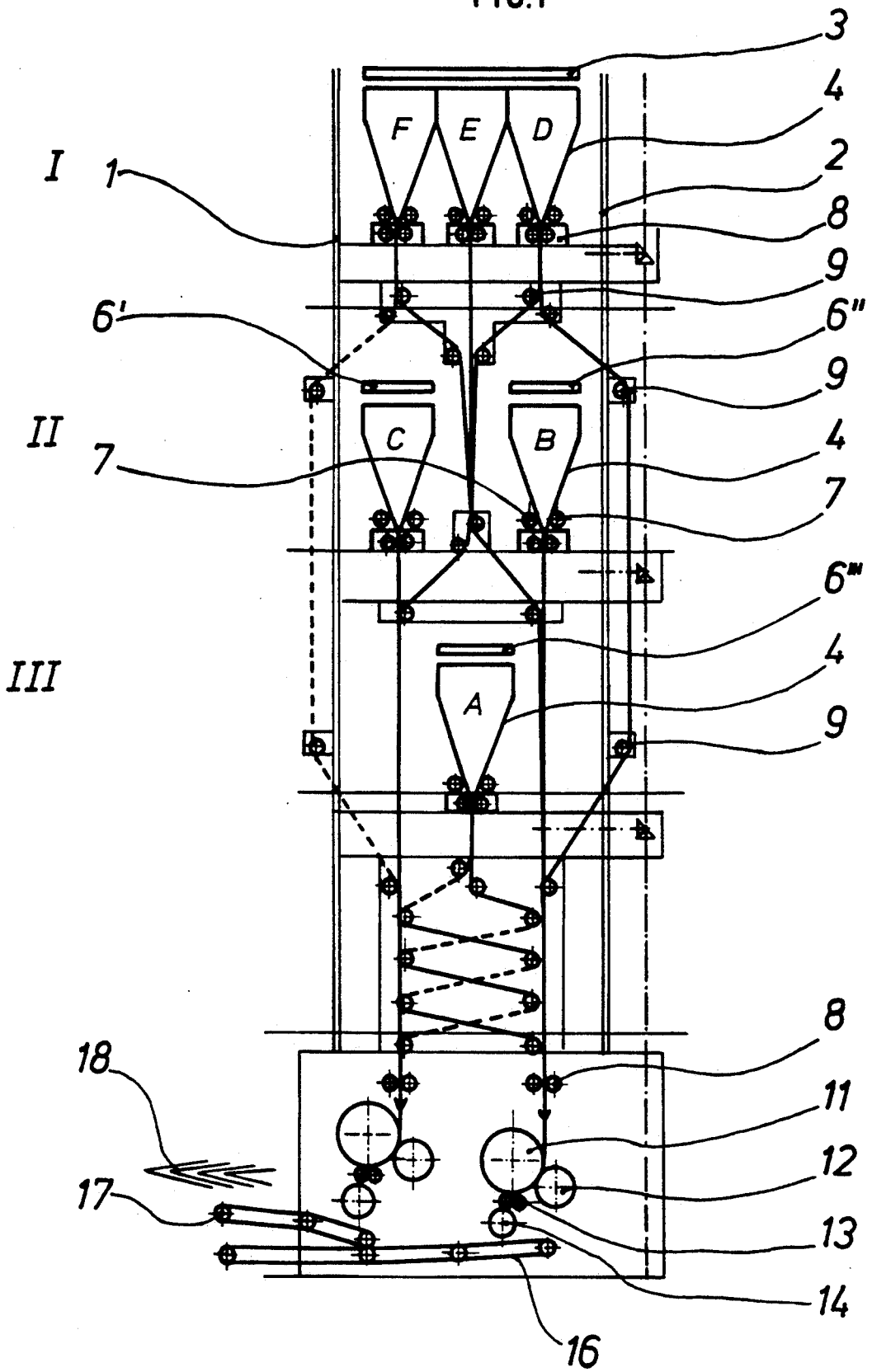
FIG. 1 is a schematic front elevation view of a web-fed rotary printing press utilizing the paper web guide assembly of the present invention.

Referring initially to FIG. 1, there may be seen a schematic depiction of a web-fed rotary printing press utilizing the paper web guide assembly of the present invention. In this web fed rotary press the printing cylinders, which print the web that is to be longitudinal slit and formed into ribbons which are then cross cut and folded into product, are provided as six plate width cylinders. While the specific six plate width printing cylinders are not shown in the drawings, it will be understood that they are of generally conventional construction.

A pair of spaced side frames 1 and 2 of the machine frame of the web-fed rotary printing press support a plurality of longitudinal formers 4 on three levels I, II and III. Each of these longitudinal formers is generally conventional and receives a printed web section which it cuts and longitudinally forms into a ribbon in which the web has been formed or laid onto itself so that its width is one half of the web section which entered the longitudinal former 4.

In the first or upper level I longitudinal formers 4, a paper web 3 is received from a six plate width web-fed rotary press which is not shown in the drawings. This paper web 3 is cut and formed by the three adjacent longitudinal formers in upper level I into three similar ribbons D, E, and F.

A second paper web 6 which has also been printed on a six plate width impression cylinder of a second web-fed rotary press that is not specifically shown in the drawings, is divided into three paper web segments 6', 6'', and 6''' by a paper guide system not specifically shown. These three web segments 6', 6'', and 6''' are each directed to separate longitudinal formers 4 that are arranged in intermediate or second level II and lower or third level III. In the paper web guide assembly depicted in FIGS. 1 and 2, the intermediate level II includes two longitudinal formers 4 that form web segments 6' and 6'' into ribbons B and C while the lower level III includes a single longitudinal former 4 that forms web segment 6''' into ribbon A.

Each of the longitudinal formers 4 of levels I, II, and III is provided with suitable nip rollers 7 which receive the formed ribbons from the longitudinal formers. These formed ribbons A, B, C, D, E and F also pass through suitable drag roller pairs 8 that are positioned immediately after, in the direction of web travel, the nip rollers 7. The ribbons A to F are led through the web-fed rotary press by means of paper guide systems which include suitable lead rollers 9. As may also be seen in FIG. 1, the assembled ribbons A to F are then run over further drag roller pairs 8 in the direction indicated by the arrows on the webs and are received by one or more folding cylinders 11. Each such folding cylinder 11 cooperates with a cutting cylinder 12 and fold rollers 13 together with a delivery fan wheel 14 to deliver a folded and cut product 18 by way of delivery conveyors 16 or 17.

Figure 2:
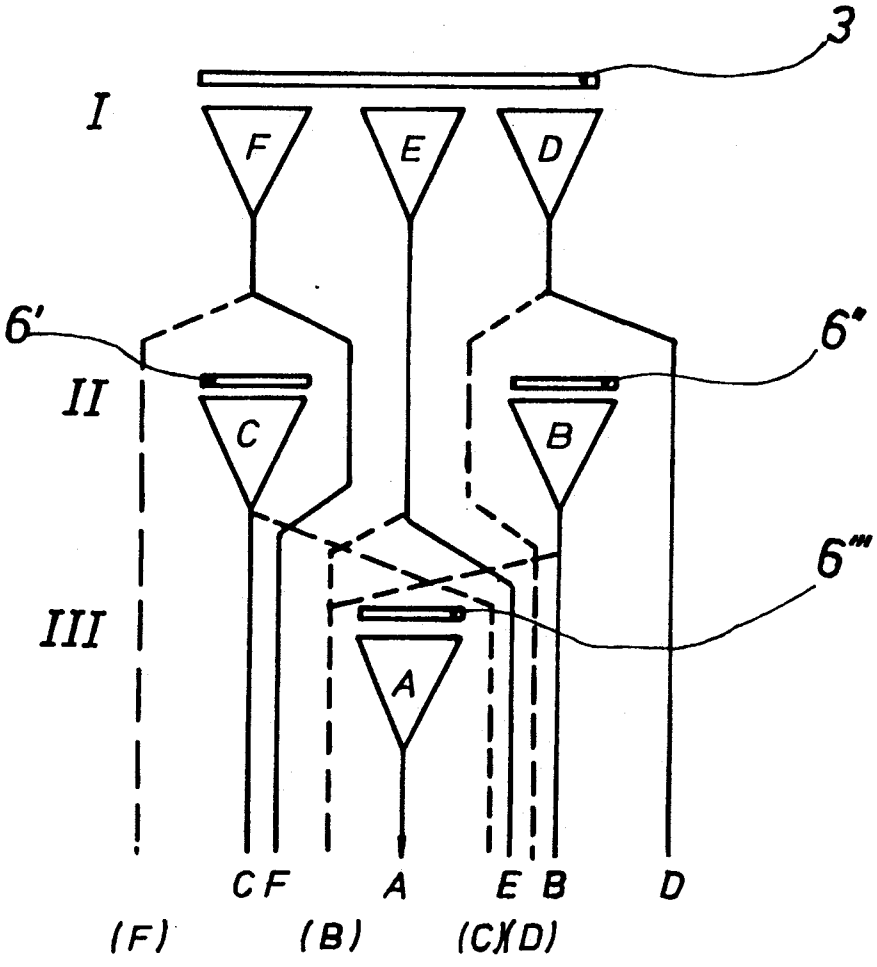
FIG. 2 is a schematic depiction of a first preferred arrangement of the longitudinal formers of FIG. 1.
Figure 4:
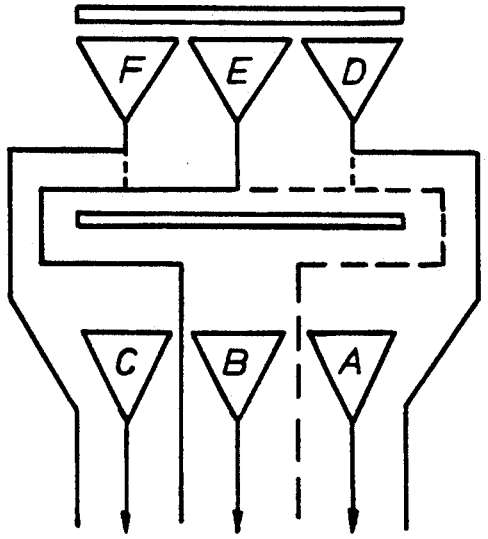
FIG.4 PRIOR ART
FIG. 4 is a schematic depiction of a prior art arrangement of longitudinal formers such as shown in U.S. Pat. No. 3,942,782.
Figure 5:
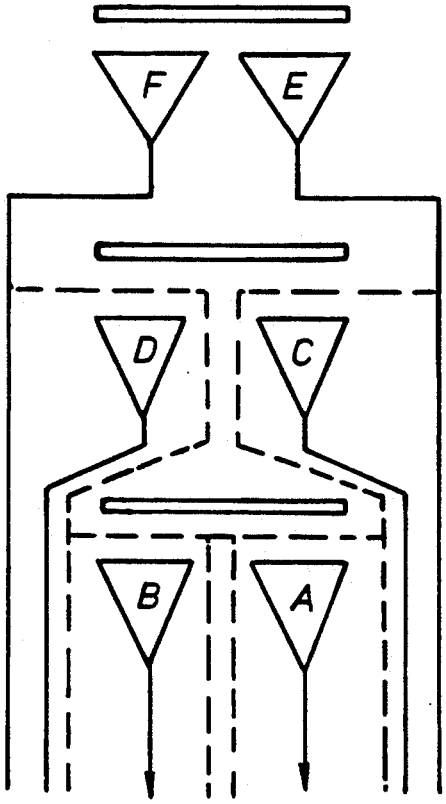
FIG.5 PRIOR ART
FIG. 5 is a schematic depiction of a prior art arrangement of longitudinal formers which are commercially available from Goss and Toshiba.

Referring now primarily to FIG. 2 there is shown in a schematic manner the various formed ribbon paths available utilizing the paper web guide assembly of the present invention in which the upper level I has three longitudinal formers 4, the intermediate level II has two longitudinal formers 4 and the lower level III has one longitudinal former 4. The solid lines emanating from each of the formers show one possible arrangement of paths of travel for the formed ribbons A to F. The dashed lines for the formed ribbons B, C, D, E and F denote alternate paths of travel. As can be appreciated by reviewing FIG. 2 a number of possible paths of travel of the formed ribbons may be provided by using the three levels of longitudinal formers 4.

Figure 3:
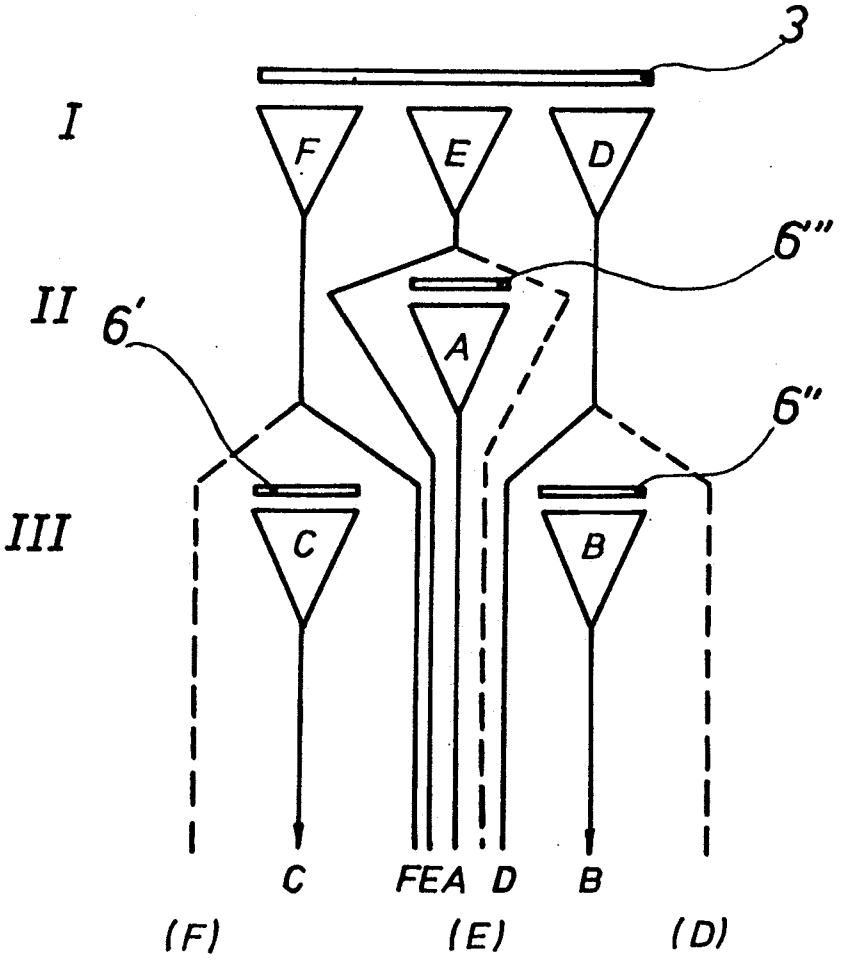
FIG. 3 is a schematic depiction of a second preferred embodiment of the longitudinal formers of FIG. 1.

Turning now to FIG. 3 there may be seen a second arrangement of a paper web guide assembly in accordance with the present invention. In this second arrangement the upper level I again has three adjacent longitudinal formers 4. However, the intermediate level II has only one longitudinal former 4 which forms ribbon A. The lower level III has two longitudinal formers 4 which form ribbons B and C. As was the situation with the paper web guide assembly of FIG. 2, the paper web guide assembly of FIG. 3 also provides a plurality of possible travel paths for the formed ribbons D, E and F.

By way of example and referring to FIGS. 2 and 3, the paper web guide assembly of the present invention, through the use of the three levels of longitudinal formers and the division of the paper web 6 into the paper web segments 6', 6'' and 6''' makes it possible to bring the ribbons E and F at the same time between the ribbons A and C or to bring the ribbons D and E at the same time between the ribbons A and B. These two variations in ribbon travel paths are exemplary of the plurality of travel paths that are possible using the paper web guide assembly of the present invention. These various travel paths can be accomplished with a minimum number of ribbon turns and hence with a minimal disturbance or displacement of each of the ribbons A to F.

While a preferred embodiment of a paper web guide assembly in accordance with the present invention has been set forth fully and completely hereinabove, it will be apparent to one of skill in the art that various changes in, for example the type of rotary web-fed press, the supports for the longitudinal formers, the supports for the rollers and the like can be made without departing from the true spirit and scope of the present invention which is accordingly to be limited only by the following claims.

What is claimed is:

1. A paper web guide assembly for use in a web-fed rotary printing press, said paper web guide assembly comprising:

an upper forming level having three upper longitudinal formers;

a first printed web having a six printing plate web width, said first printed web being divided into three first web segments which are formed by said three upper longitudinal formers in said upper forming level into three longitudinally folded first ribbons;

an intermediate forming level having at least one intermediate longitudinal former;

a lower forming level having at least one lower longitudinal former, there being a total of three longitudinal formers on said intermediate and lower forming levels; and a second printed web having a six printing plate web width, said second printed web being divided into three second web segments each having a two printing plate web width, each of said three second web segments being longitudinally folded by a cooperating one of said three intermediate and lower longitudinal formers on said intermediate and lower forming levels into three longitudinally folded second ribbons, said three longitudinally folded first ribbons and said three longitudinally folded second ribbons being combinable after, in a direction of web segment travel, said lower forming level.

2. The paper web guide assembly of claim 1 wherein said intermediate level has two longitudinal formers and said lower level has one longitudinal former.

3. The paper web guide assembly of claim 1 wherein said intermediate level has one longitudinal former and said lower level has two longitudinal formers.

* * * * *